US007909503B2

(12) United States Patent
Hiranuma

(10) Patent No.: US 7,909,503 B2
(45) Date of Patent: Mar. 22, 2011

(54) PORTABLE TIMEPIECE AND METHOD OF FABRICATING CROWN PROVIDED TO THE TIMEPIECE

(75) Inventor: Haruki Hiranuma, Chiba (JP)

(73) Assignee: Seiko Instruments Inc. (JP)

( * ) Notice: Subject to any disclaimer, the term of this patent is extended or adjusted under 35 U.S.C. 154(b) by 238 days.

(21) Appl. No.: 12/156,902

(22) Filed: Jun. 4, 2008

(65) Prior Publication Data

US 2009/0003142 A1 Jan. 1, 2009

(30) Foreign Application Priority Data

Jun. 28, 2007 (JP) ..... 2007-169943

(51) Int. Cl.
*G04B 29/00* (2006.01)

(52) U.S. Cl. ..... 368/308; 368/320

(58) Field of Classification Search ..... 368/185, 368/190, 288–290, 308, 319–321
See application file for complete search history.

(56) References Cited

U.S. PATENT DOCUMENTS

| | | | | |
|---|---|---|---|---|
| 2,309,428 | A * | 1/1943 | Aegler | 368/288 |
| 2,482,317 | A * | 9/1949 | Borer | 368/288 |
| 3,453,819 | A * | 7/1969 | Simon | 368/290 |
| 4,089,158 | A * | 5/1978 | Wenger | 368/216 |
| 4,313,187 | A * | 1/1982 | Waki et al. | 368/319 |
| 5,383,166 | A * | 1/1995 | Gallay | 368/288 |
| 2002/0167866 | A1 * | 11/2002 | Oomori et al. | 368/191 |
| 2005/0088920 | A1 * | 4/2005 | Hiranuma et al. | 368/319 |
| 2005/0094498 | A1 | 5/2005 | Koshoji et al. | 368/319 |

FOREIGN PATENT DOCUMENTS

JP 2005127816 5/2005

* cited by examiner

*Primary Examiner* — Vit W Miska
(74) *Attorney, Agent, or Firm* — Adams & Wilks

(57) ABSTRACT

A portable timepiece has a timepiece movement disposed in a case band. A pipe extends through and is attached to the case band and has a male screw portion on a part of the pipe that extends outside the case band. A crown has a crown head and a crown shaft, and the crown head has a female screw portion threadedly engaged with the male screw portion and disengageable therefrom in response to rotation of the crown head in a loosening direction accompanied by axial movement of the crown head in a direction away from the case band. The crown shaft has one end portion that extends into the pipe and is connected to a hand setting stem of the timepiece movement and another end portion that extends outside the case band beyond the pipe and slidably contacts an inner peripheral surface of the crown head to support the crown head and guide the axial movement thereof. The crown shaft has a force receiving portion for receiving a rotational force to rotate the hand setting stem, and the crown head has a force transmitting portion that releasably engages with the force receiving portion during axial movement of the crown head away from the case band to enable a rotational force to be transmitted to the force receiving portion by rotating the crown head. The end portion of the crown shaft that slidably contacts the inner peripheral surface of the crown head constitutes the force receiving portion of the crown shaft.

20 Claims, 7 Drawing Sheets

PORTABLE TIMEPIECE AND METHOD OF FABRICATING CROWN PROVIDED TO THE TIMEPIECE

BACKGROUND OF THE INVENTION

1. Field of the Invention

The present invention relates to a portable timepiece in which a crown is held so as not to be carelessly rotated by utilizing mesh of screws and a method of fabricating a crown provided to the timepiece.

2. Description of the Related Art

In a background art, there is a portable timepiece including a screw lock structure for holding a crown so as not to be rotated carelessly by utilizing mesh of screws. According to the screw lock structure, the crown includes a crown shaft for cooperatively moving a hand setting stem and a crown head for rotating the shaft. Further, a shaft end portion of the crown shaft is arranged at outside of a pipe having a male screw portion and fixed to a case band. Along therewith, a peripheral portion of the shaft end portion is formed with a rotational force receiving portion of a deformed shape and the crown head is provided with a female screw portion and a rotational force transmitting portion of a deformed shape.

The rotational force transmitting portion is provided with a diameter larger than that of the female screw portion and is formed continuously to the female screw portion. Therefore, from a necessity of working the rotational force transmitting portion, the crown head is formed by a head main body one end directed to a side of the case band of which is opened, and a cap constituting a part separate from the head main body, and the cap is mounted to close other end of the head main body.

According to the timepiece, the female screw portion is attachably and detachably brought in mesh with a male screw portion and the crown can be held so as not to be rotated carelessly by a mesh thereof. The rotational force transmitting portion is attachable and detachable to and from the rotational force receiving portion. That is, in the screw lock state in which the female screw portion is brought in mesh with the male screw portion, the rotational force transmitting portion is separated from the rotational force receiving portion. In a state of releasing the screw lock by releasing the mesh of the female screw portion and the male screw portion, in accordance with moving the crown head by an urge force of an elastic member, the rotational force transmitting portion is fitted to the rotational force receiving portion. Therefore, when the crown head is operated to rotate in a state of releasing the screw lock, the rotation is transmitted to the crown shaft by way of the rotational force transmitting portion and the rotational force receiving portion which are fitted together and the hand setting stem can be rotated (refer to, for example, JP-A-2005-127816 (paragraphs 0011-0055, FIG. 1-FIG. 5)).

According to the timepiece of Patent Reference 1, there is achieved an advantage of capable of lightly operating a screw locking operation since in operating to rotate to bring the female screw portion of the crown head in mesh with the male screw portion of the pipe in order to achieve the screw lock state, the hand setting stem is not rotated cooperatively therewith.

However, when the screw lock is released, during a time period after releasing the mesh of the female screw portion and the male screw portion, until the rotational force transmitting portion is engaged with the rotational force receiving portion, the crown head is not supported and there is a possibility of shaking the crown head. Therefore, there is a case in which the operation of the crown head becomes unstable and the rotational force transmitting portion cannot smoothly been gaged with the rotational force receiving portion. Further, by the same reason, in bringing the female screw portion in mesh with the male screw portion in order to constitute the screw lock state, when the crown head is unstable, there is a case in which the mesh cannot smoothly be carried out and when a user forcibly constitutes the mesh under the state, there is conceivable a concern of damaging the screw portion.

Further, according to the timepiece of Patent Reference 1, the female screw portion having a diameter smaller than that of the rotational force transmitting portion and being integral with the crown head is provided continuously to the rotational force transmitting portion. Thereby, when the rotational force transmitting portion having the deformed shape is formed on an inner side of the crown head, the female screw portion constitutes a hindrance against working of the rotational force transmitting portion. Therefore, working using a shaper cannot be carried out. Along therewith, punching cannot be carried out when working is carried out by using a press. In this way, working suitable for mass production performance cannot be carried out, and therefore, special devise is needed for working the rotational force transmitting portion and a concern of being difficult to work the rotational force transmitting portion accurately is conceivable.

SUMMARY OF THE INVENTION

It is an aspect of the present invention to provide a portable timepiece capable of promoting an operability of a crown head in a state of releasing screw lock.

It is another aspect of the present invention to provide a method of fabricating a crown provided to a portable timepiece capable of promoting a workability of a rotational force transmitting portion provided to a crown head of a crown used for achieving the aspect mentioned above.

A portable timepiece of the invention is a portable timepiece, wherein a case band including a timepiece movement is attached with a pipe having a male screw portion disposed on an outer side of the case band, a crown connected to a hand setting stem for transmitting a rotational force to the timepiece movement is brought in mesh with the male screw portion attachably and detachably, and the crown is held so as not to be rotated by bringing the crown in mesh with the male screw portion, and is characterized in that a crown guide having a diameter to be brought into contact with an inner peripheral face of a head main body constituting a cylindrical shape of a crown head is provided at a portion arranged at the outside of the pipe of the crown shaft for cooperatively moving the hand setting stem in a state of releasing the crown and the male screw portion from being brought in mesh with each other and covered by the crown head provided to the crown, and a movement in an axial direction of the crown head is guided by the crown guide.

According to the invention, the crown guide provided at the crown shaft is lightly brought into contact with or extremely proximate to the inner peripheral face of the crown head, and therefore, the crown head can be supported by the crown guide from the inner side. Therefore, when the crown head is moved in the axial direction in a state of releasing the screw lock for the crown, the movement of the crown head can be guided by the crown guide. Therefore, the crown head can be moved in the axial direction stably so as not to shake the crown head. Thereby, when brought into the screw lock state, the female screw portion of the screw ring can properly be started to be brought in mesh with the male screw portion of the pipe.

According to a preferable embodiment of the portable timepiece of the invention, it is characterized that a rotational force transmitting portion including a first engaging portion is provided at an inner face of the head main body in the cylindrical shape provided to the crown head, and a rotational force receiving portion including a second engaging portion formed by a shape in correspondence with the first engaging portion and engaged and detached with and from the first engaging portion by the movement in the axial direction of the crown head serves also as the crown guide.

According to the invention, it is not necessary to form the crown guide and the rotational force receiving portion at the crown shaft to be aligned along the axial direction. Therefore, in comparison with the constitution of aligning the crown guide and the rotational force receiving portion, a length of the crown shaft and a length of the crown can be prevented from being prolonged. Along therewith, one of the crown guide and the rotational force receiving portion do not constitute a hindrance in working other thereof as in the constitution of aligning the crown guide and the rotational force receiving portion, and therefore, the crown shaft can easily be worked.

Further, a portable time piece of the invention is a portable time piece, wherein a case band including a timepiece movement is attached with a pipe having a male screw portion disposed on an outer side of the case band, a crown connected to a hand setting stem for transmitting a rotational force to the timepiece movement is brought in mesh with the male screw portion attachably and detachably, and the crown is held so as not to be rotated by bringing the crown in mesh with the male screw portion, the crown including a crown shaft including a rotational force receiving portion of a deformed shape formed with a first engaging portion at an outer periphery thereof, having a diameter larger than a diameter of the male screw portion, arranged at outside of the pipe and cooperatively moving the hand setting stem in a state of releasing the crown and the male screw portion from being brought in mesh with each other, a crown head, wherein other end of a head main body opening one end thereof is closed by a closed portion, further, an inner periphery of the head main body includes a rotational force transmitting portion, a ring mounting face in a circular shape, and an inner peripheral face in a circular shape, the rotational force transmitting portion is constituted by a shape having a second engaging portion engaged with and detached from the first engaging portion and fitted attachably and detachably to the rotational force receiving portion, the ring mounting face is formed on the one end side from the rotational force transmitting portion by diameter equal to or larger than a maximum diameter of the rotational force transmitting portion, and the inner peripheral face is formed on the other end side from the rotational force transmitting portion by a diameter equal to or larger than the maximum diameter of the rotational force transmitting portion and a diameter brought into outer contact with the first engaging portion, a screw ring including a female screw portion attachably and detachably brought in mesh with the male screw portion and having a diameter smaller than a diameter of the rotational force receiving portion and mounted to the ring mounting face, and an elastic member squeezed between the crown head and the crown shaft for urging the crown head in a direction of being separated from the case band.

According to the invention, the first engaging portion provided to the rotational force receiving portion of the crown shaft is lightly brought into contact with or extremely proximate to the inner peripheral face of the crown head, and therefore, the crown head can be supported by the rotational force receiving portion from the inner side. Therefore, when the crown head is moved in the direction of being separated from the case band by the urge force of the elastic member in accordance with releasing the screw look for the crown, and when the crown head is moved to the case band against the urge force of the elastic member by bringing about the screw lock state from the state of releasing the screw lock for the crown, the movement of the crown head can be guided by the rotational force receiving portion. Therefore, the crown head can be moved in the axial direction stably so as not to shake the crown head, thereby, in bringing about the screw lock state, the female screw portion of the screw ring can properly started to be brought in mesh with the male screw portion of the pipe. When the crown head is moved in the direction of being separated from the case band, the screw ring impinges on the rotational force receiving portion from the side of the case band, and therefore, the crown head can be prevented from being detached by the urge force of the elastic member by constituting a stopper by the rotational force receiving portion.

According to the preferable embodiment of the portable timepiece of the invention, an inserting portion formed to be brought into inner contact with the female screw portion is made to be continuous to the male screw portion of the pipe, and a length of the inserting portion is constituted by a length inserted into the screw ring in a state of disengaging the screw ring from being brought in mesh with the male screw portion.

According to the mode of the invention, when the crown is detached from the male screw portion, the inserting portion of the pipe is inserted to the screw ring mounted to the crown head, and the screw ring is guided by the inserting portion from the inner side. Thereby, the crown head can be moved in the axial direction by making the crown head stable so as not to be shaken further by the rotational force receiving portion of the crown shaft and the inserting portion of the pipe.

According to a preferable embodiment of the portable timepiece of the invention, the first and the second engaging portions are constituted by serrations.

According to the mode of the invention, in engaging the second engaging portion provided to the rotational force transmitting portion of the crown head with the first engaging portion provided to the rotational force receiving portion of the crown shaft by releasing the screw lock, when time and labor of rotating the crown head is needed, an amount of the rotation is reduced. In a state of releasing the screw lock in this way, an operability of the crown head for bringing the rotational force transmitting portion in mesh with the rotational force receiving portion is promoted, and therefore, a shift to an operation of cooperatively moving the crown shaft is smooth.

According to the preferable embodiment of the portable timepiece of the invention, the head main body and the closed portion are integrally formed.

According to the mode of the invention, there is not a seam between the head main body and the closed portion, and therefore, in comparison with a case of having the seam, an adverse influence is not effected on the contact feeling of the finger in operating the crown and also an outlook of the crown can be promoted.

Further, there is provided a method of fabricating a crown included to a portable timepiece of the invention, wherein for a head material in which other end of a head main body opening one end is closed by a closed portion, and which includes a first space in a circular shape partitioned by an inner peripheral face of a circular shape having a diameter equal to or larger than a maximum diameter of a worked projected portion between the worked projected portion provided continuously in a peripheral direction at an inner periphery of the head main body and the closed portion and including a second space in a circular shape partitioned by a ring mounting face in a circular shape having a diameter equal to or larger than the maximum diameter of the worked projected portion between the worked projected portion and the opened one end of the head main body, by a work member reaching the first space by crossing the worked projected portion from the second space, the first engaging portion is worked into the worked projected portion, and a crown head formed with a rotational force transmitting portion in a deformed shape is prepared, wherein for a crown shaft material including a shaft main portion and a shaft end portion in a circular shape expanded integrally from an outer periphery of one end portion of the shaft main portion, a second engaging portion brought into inner contact with the inner peripheral face is worked at an outer peripheral portion of the shaft end portion by a work member crossing the outer peripheral portion of the shaft end portion by being moved in an axial direction of the crown shaft material, thereby, a crown shaft formed with a rotational force receiving portion of a shape of being attachably and detachably fitted with the rotational force transmitting portion is prepared, wherein a ring material is worked by a work member penetrating the ring material in the axial direction by crossing an inner peripheral portion of the ring material, thereby, a screw ring formed by including a female screw portion having a diameter smaller than a diameter of the rotational force receiving portion is prepared. The crown head is covered to the crown shaft and the rotational force receiving portion is contained in the first space while squeezing an elastic member in a compressed state between the closed portion of the crown head and the crown shaft. Thereafter, the screw ring is mounted to the ring mounting face by press-fitting the screw ring into the second space.

According to the invention, the head material constituting the crown head includes the first space and the second space on the both sides of the worked projected portion provided continuously in the peripheral direction of the inner periphery thereof, the diameters of the ring mounting face formed by the first space and the inner peripheral face formed by the second space are made to be equal to or larger than the maximum diameter of the worked projected portion, and therefore, when the rotational force transmitting portion is formed at the worked projected portion of the head material by working the first engaging portion, the work member for working the first engaging portion is not hindered from crossing to pass through the worked projected portion by the ring mounting face and an inner peripheral face. Therefore, the rotational force transmitting portion can be worked at the crown head by working using a shaper or punching by using a press.

According to the portable timepiece of the invention, when the crown head is moved in the axial direction, the movement of the crown head is guided by the rotational force receiving portion from the inner side of the crown head, the crown head is restrained from being shaken in the state of disengaging the screw lock, and therefore, the operability of the crown head in the state of releasing the screw lock can be promoted.

According, to the method of fabricating the crown included to the portable timepiece of the invention, the rotational force transmitting portion can be worked for the crown head by working using a shaper or punching using a press, and therefore, a workability of the rotational force transmitting portion of the crown head can be promoted.

DESCRIPTION OF THE PREFERRED EMBODIMENTS

First Embodiment

A first embodiment of the invention will be explained in reference to FIG. 1 through FIG. 7.

Figure 1:
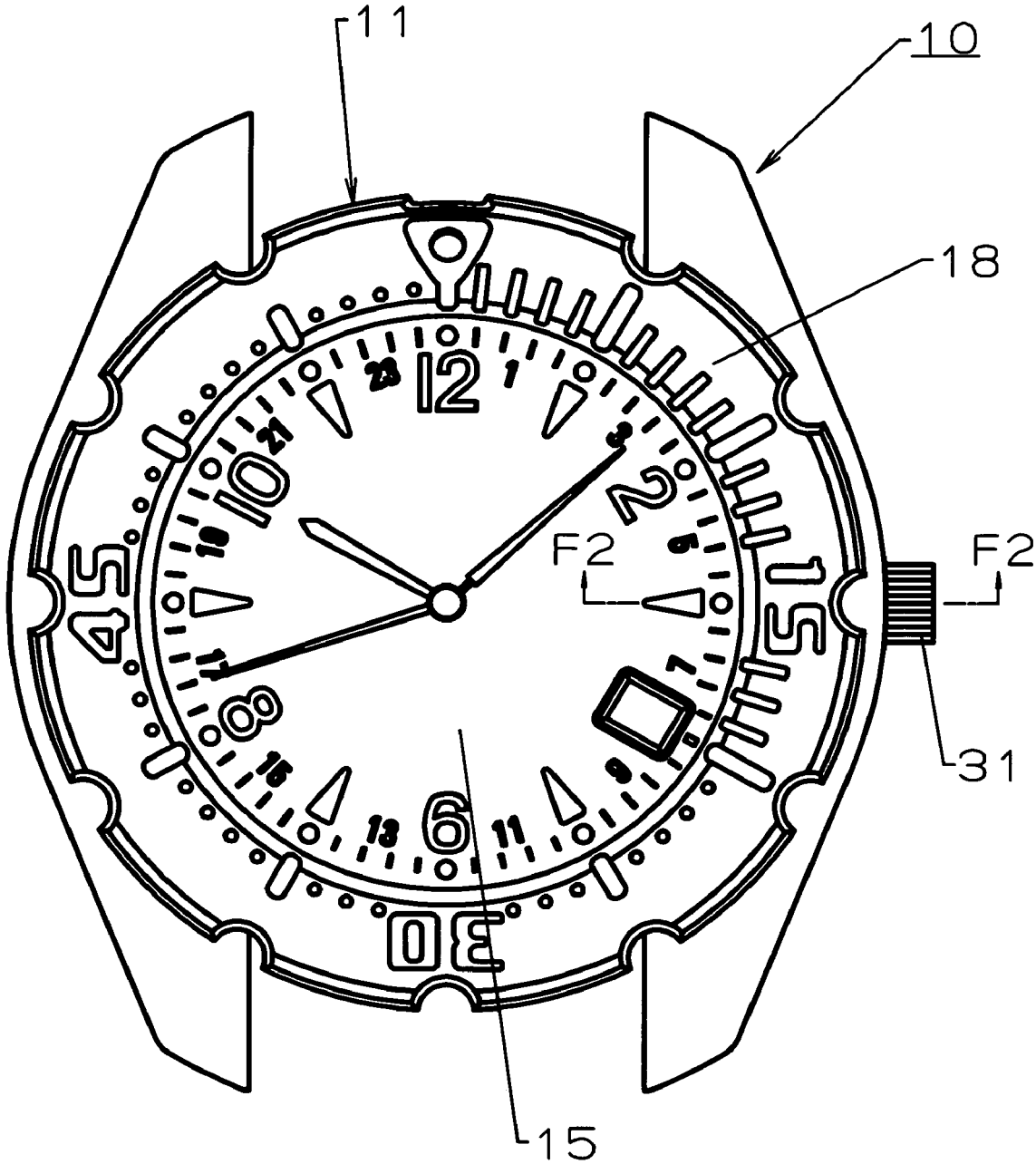
FIG. 1 is a front view showing a wrist watch according to a first embodiment of the invention.
Figure 2:
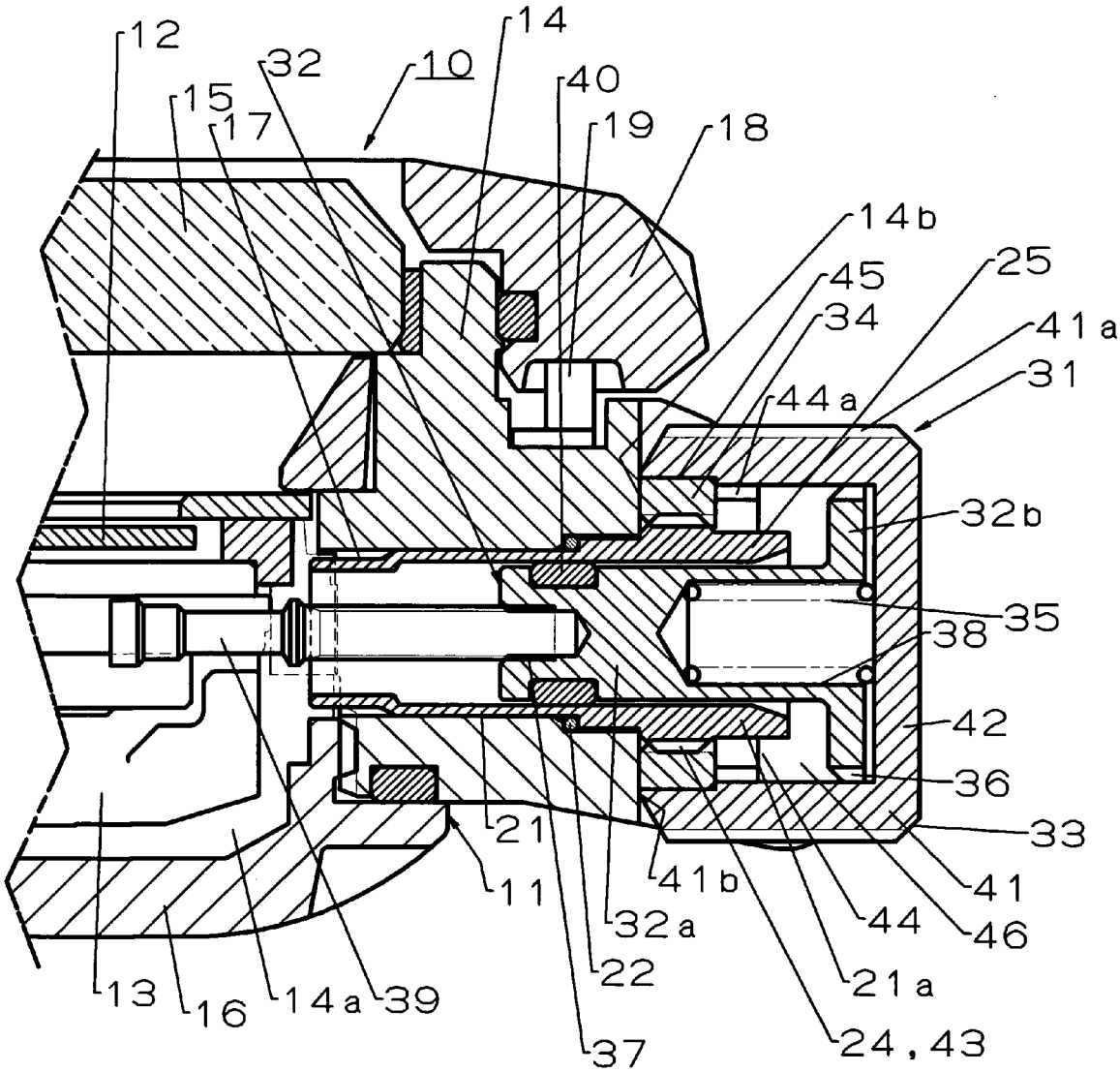
FIG. 2 is a sectional view taken along a line F2-F2 of FIG. 1 showing a screw lock state of a crown.
Figure 3:
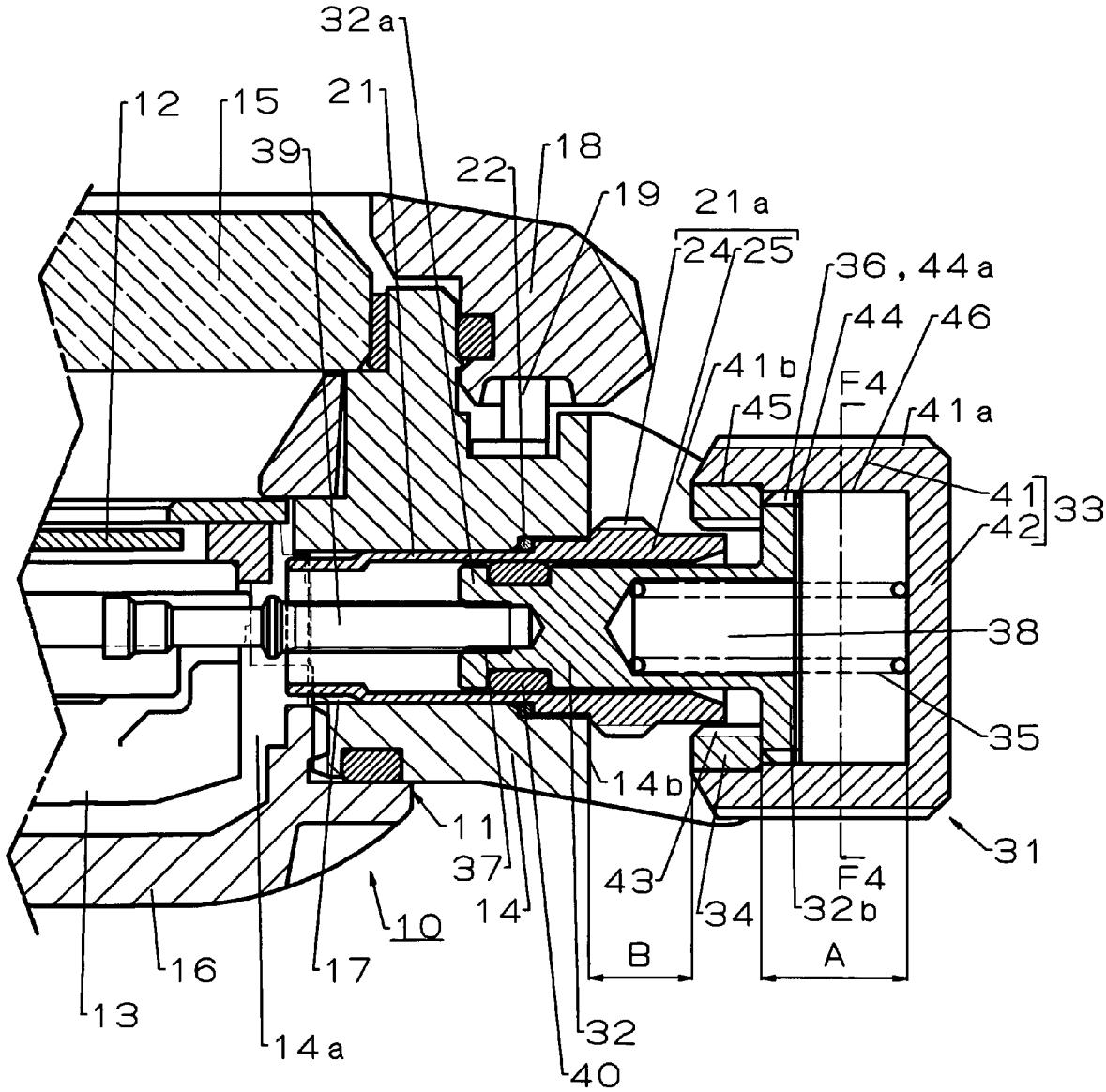
FIG. 3 is a sectional view taken along the line F2-F2 of FIG. 1 showing a state of releasing the screw lock state of the crown.

In FIG. 1, notation 10 designates a wrist watch as a portable timepiece. The wrist watch 10 contains a dial 12 as shown by FIG. 2 and FIG. 3 and a timepiece movement 13, not illustrated, and the like at inside of a timepiece exterior assembly 11. As the timepiece movement 13, there is used a mechanical type timepiece movement of a hand winding type constituting a power source by a mainspring, or an automatic winding type, or a type using both of the hand winding and the automatic winding. Further, in place thereof, there can also be used a timepiece movement of a type capable of switching time indication or the like on the dial 12 by selecting a digital indication and an analog indication.

As shown by FIG. 2 and FIG. 3, the timepiece exterior assembly 11 is formed by mounting a cover glass 15 in a liquid tight manner to a front face constituted by one face in a thickness direction of a case band 14 made of a metal constituting a ring-like shape and screwing a case back 16 comprising a metal or the like in a liquid tight manner to a back face constituted by the other face in the thickness direction of the case band 14. The dial 12 is optically recognizable or viewable through the cover glass 15. The case back 16 is removable. Further, in FIG. 1 through FIG. 3, notation 18 designates a bezel in a ring-like shape attached to the timepiece exterior assembly 11 to be able to be operated to rotate. The bezel 18 can be rotated by constant angles and is held at an arbitrary rotational position by a holding member 19 capable of being deformed elastically and engaged and disengaged to and from the bezel 18. The bezel 18 and the holding member 19 can be omitted.

As shown by FIG. 2 and FIG. 3, a portion of the case band 14 is opened with a pipe attaching hole 17 penetrating the case band 14 in a diameter direction. One end of the pipe attaching hole 17 is opened to a space 14*a* at inside of the case band surrounded by the case band 14, and other end of the pipe attaching hole 17 is opened to an outer side face 14*b* of the case band 14.

The case band 14 is attached with a pipe 21 by being inserted to the pipe attaching hole 17 from an outer side of the case band by brazing or the like. Notation 22 in FIG. 2 and FIG. 3 designates a brazing material. The pipe 21 made of a metal, for example, stainless steel is constituted by a shape of a circular cylinder, both ends in an axial direction thereof are respectively opened, and the pipe 21 includes a pipe end portion 21*a* arranged at an outer portion of the case band 14, and an outer periphery of the pipe end portion 21*a* includes a male screw portion 24 for holding a crown 31 in a screw lock state.

The pipe end portion 21*a* includes an inserting portion 25 continuous to the male screw portion 24 in a direction of being remote from the case band 14. As shown by FIG. 3, the inserting portion 25 is provided with a length inserted to a screw ring 34, mentioned later, even in a state of releasing screw lock. An outer diameter of the inserting portion 25 is constituted by a diameter which is smaller than a diameter of the male screw portion 24 and brought into contact (inner contact) with a female screw portion 43, mentioned later, from an inner side thereof.

The crown 31 includes a crown shaft 32, a crown head 33, the screw ring 34, an elastic member, for example, a coil spring 35.

The crown shaft 32 is made of, for example, a metal, preferably, stainless steel and includes an inserting shaft portion 32*a* in a shape of a circular column inserted from outside of the case band 14 into the pipe 21, and a rotational force receiving portion 32*b* constituted by a shaft end portion arranged at outside of the pipe 21 continuously integrally to the inserting shaft portion 32*a* as shown by FIG. 2 and FIG. 3.

The rotational force receiving portion 32*b* is expanded in a circular shape from an outer periphery of an end portion of the inserting shaft portion 32*a*. A diameter of the rotational force receiving portion 32*b* is not less than an outer diameter of the male screw portion 24. An outer diameter of the rotational force receiving portion 32*b* is constituted by a size brought into inner contact with an inner peripheral face 46, mentioned later, that is, brought into contact with the inner peripheral face 46 from an inner side of the crown head 33, thereby, the rotational force receiving portion 32*b* serves also as a crown guide.

Figure 4:
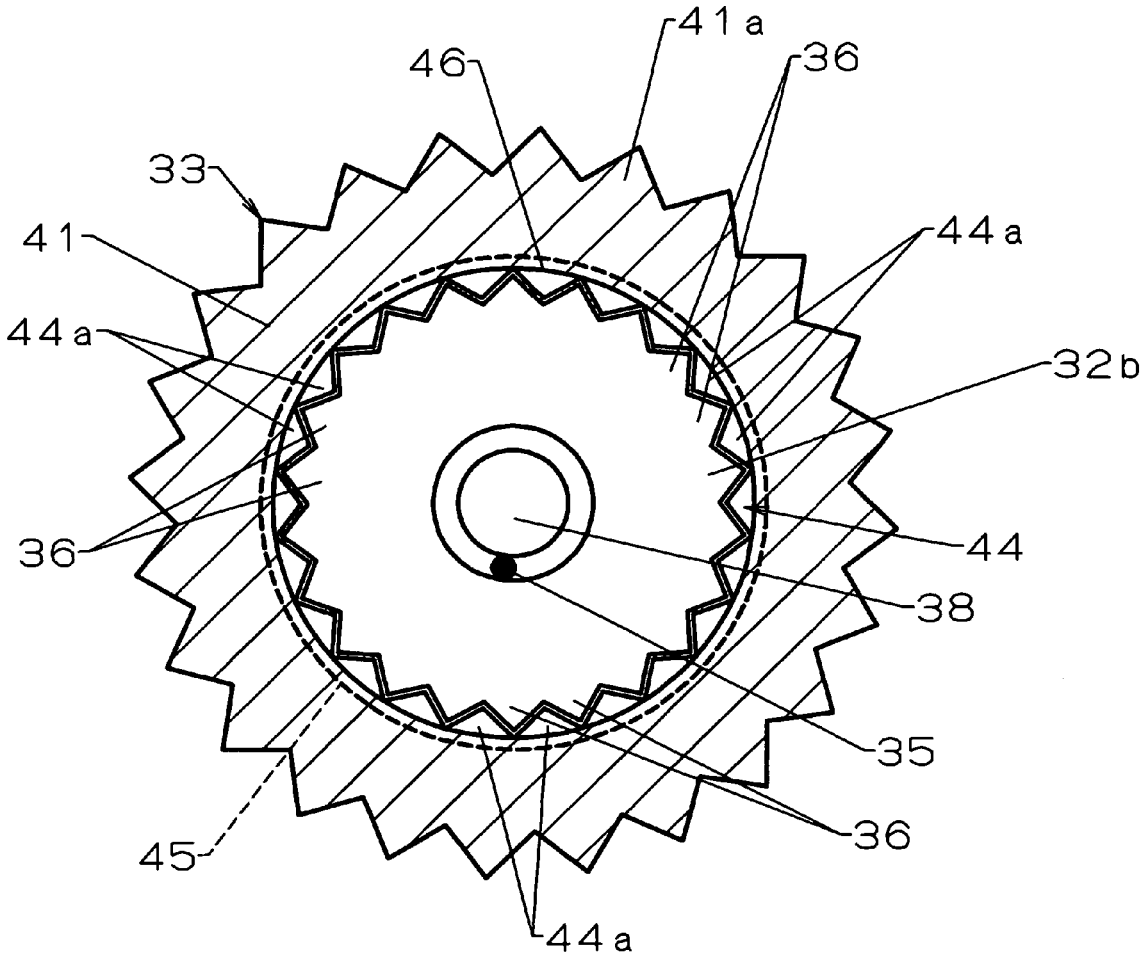
FIG. 4 is a sectional view taken along a line F4-F4 of FIG. 3.

Therefore, the rotational force receiving portion 32*b* is constituted by a deformed shape by including a first engaging portion serving as an engagement for receiving a rotational force at an outer peripheral portion thereof. Specifically, as shown by FIG. 4, there is formed the rotational force receiving portion 32*b* in a shape of an outer teeth gear by including a serration formed with a plurality of teeth (first engaging portion) 36 projected outwardly at a peripheral portion of the rotational force receiving portion 32*b* and aligned in a peripheral direction of the peripheral portion preferably continuously. Although according to an example of FIG. 4, a triangular teeth serration is constituted, the invention is not restricted thereto. The tooth 36 of the rotational force receiving portion 32*b* may be constituted by a spline of a square shape or the like.

The crown shaft 32 is provided with a screw hole 37 cut from a front end side of the inserting shaft portion 32*a* along the axial direction and is provided with a spring containing hole 38 opened to a center portion of an end face of the rotational force receiving portion 32*b*.

A hand setting stem 39 for transmitting the rotational force of the crown 31 to the timepiece movement 13 is screwed from an inner side of the case band 14 to the screw hole 37 of the inserting shaft portion 32*a*. The hand setting stem 39 and the crown shaft 32 connected to each other, thereby, cannot be moved in the axial direction. A recessed portion in a ring-like shape formed at an outer periphery of a front end portion of the inserting shaft portion 32*a* is mounted with a waterproof packing 40 in a ring-like shape constituted by an elastic material of rubber or the like. The waterproof packing 40 is elastically brought into close contact with inner peripheries of the ring-like recessed portion and the pipe 21, thereby, the waterproof is carried out between the inner periphery of the pipe 21 and the crown shaft 32.

The crown head 33 is made of a metal of, for example, stainless steel or the like, and is formed in a cap-like shape by including a head main body 41 one end of which is opened and a closed portion 42 closing other end of the head main body 41 as shown by FIG. 2 and FIG. 3. The head main body 41 and the closed portion 42 are integral as a preferable example. Thereby, there is not a seam between the head main body 41 and the closed portion 42, and therefore, in comparison with a case of including a seam, an adverse influence is not effected on a contact feeling of the finger in operating the crown 31 and also an outlook of the crown 31 can be promoted.

As shown by FIG. 2, the head main body 41 is formed by a shape of a circular cylinder constituting a size capable of containing the male screw portion 24 and the inserting portion 25, and an outer periphery thereof includes recesses and projections 41*a* (refer to FIG. 4 and FIG. 5) for stopping slipping in being operated to rotate. An opened one end 41*b* of the head main body 41 is made to be brought into contact with and separated from the outer side face 14*b* of the case band 14.

The head main body 41 includes a rotational force transmitting portion 44, and a ring mounting face 45 and the inner peripheral face 46 provided on both sides of the rotational force transmitting portion 44 at an inner periphery thereof.

The rotational force transmitting portion 44 is provided at a middle portion in the axial direction of the head main body 41. The rotational force transmitting portion 44 is releasably engageable with and disengageable from the rotational force receiving portion 32*b* in accordance with a movement in the axial direction of the crown head 33, and is constituted by a shape similar to that of the first engaging portion of the rotational force receiving portion 32*b*, and therefore, in the case of the embodiment, as exemplified in FIG. 4 and FIG. 5, the rotational force transmitting portion 44 is constituted by a deformed shape. Specifically, the rotational force transmitting portion 44 having a shape of an inner teeth gear is formed by being projected from the inner periphery of the head main body 41 to a center portion of the head main body 41 and including a serration produced by a plurality of teeth (second engaging portions) 44*a* aligned in a peripheral direction of the inner periphery, preferably continuously, serving as an engagement for transmitting the rotational force. Although in the example of FIG. 4 and FIG. 5, a triangular teeth serration is constituted, the invention is not restricted thereto. The tooth 44*a* of the rotational force transmitting portion 44 may be constituted by a spline of a square shape or the like.

Figure 5:
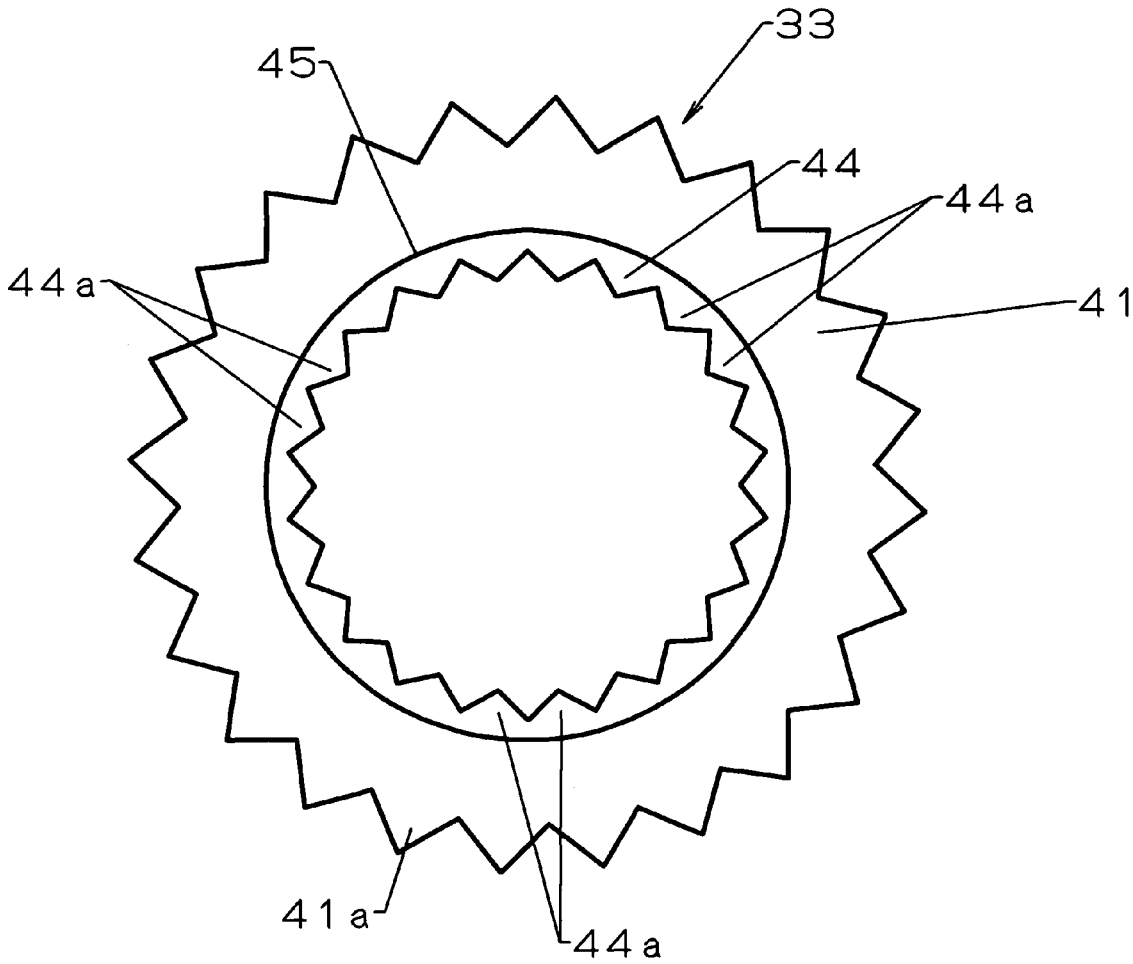
FIG. 5 is a front view showing a crown head provided to the wrist watch of FIG. 1.

The ring mounting face 45 is formed by an inner peripheral portion on a side of one end 41*b* of the head main body 41 from the rotational force transmitting portion 44. As shown by FIG. 5, the ring mounting face 45 is constituted by a circular shape. A diameter of the ring mounting face 45 is equal to or larger than a maximum diameter of the rotational force transmitting portion 44. Here, the maximum diameter of the rotational force transmitting portion 44 indicates a circle passing a tooth bottom of the tooth 44*a* produced by the serration, and the ring mounting face 45 is formed by a diameter larger than that of the tooth bottom circle as a preferable example according to the embodiment.

The inner peripheral face 46 is formed by an inner peripheral portion on a side of the closed portion 42 of the head main body 41 from the rotational force transmitting portion 44. The inner peripheral face 46 is constituted by a circular shape and a length A in the axial direction of the inner peripheral face 46 (refer to FIG. 3) is equal to or larger than an axial direction moving distance B (refer to FIG. 3) of the crown head 33 constituting a reference by the outer side face 14*b* of the case band 14. A diameter of the inner peripheral face 46 is equal to or larger than the maximum diameter (the tooth bottom circle) of the rotational force transmitting portion 44 and is a diameter at which the inner peripheral face 46 is brought into outer sliding contact with the respective teeth 36 of the rotational force receiving portion 32*b*, that is, brought into slidable contact with the respective teeth 36 from an outer side of the rotational force receiving portion 32*b* and is the same as the diameter of the tooth bottom circle of the rotational force transmitting portion 44 according to the embodiment.

Figure 6:
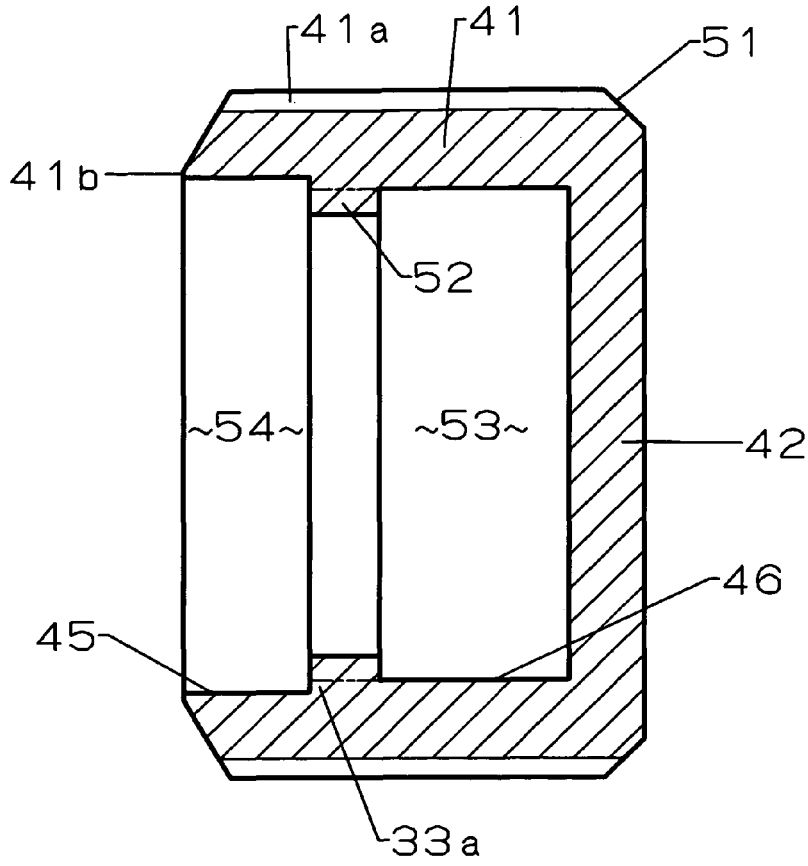
FIG. 6 is a sectional view showing a head material of forming the crown head provided to the wrist watch of FIG. 1.
Figure 7:
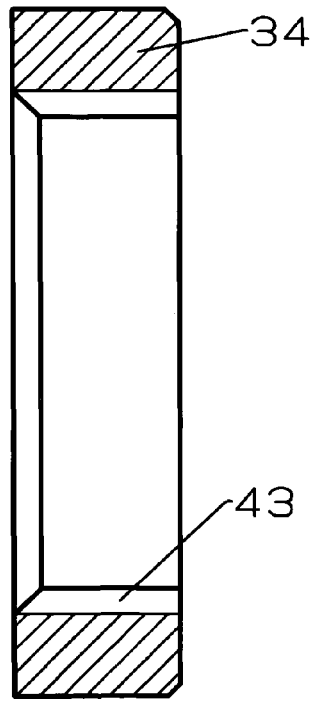
FIG. 7 is a sectional view showing a screw ring provided to the wrist watch of FIG. 1.

The screw ring 34 shown in FIG. 7 and the like is made of, for example, a metal and includes the female screw portion 43 removably brought in mesh with the male screw portion 24 to achieve the screw lock state of the crown 31 at an inner periphery thereof. An inner diameter of the screw ring 34, that is, a nominal diameter of the female screw portion 43 is smaller than that of the rotational force receiving portion 32*b* and is constituted by a size brought into contact (outer contact) with an outer periphery of the inserting portion 25 from outside thereof. An outer diameter of the screw ring 34 is substantially the same as the diameter of the ring mounting face 45. The screw ring 34 is mounted to the ring mounting face 45 by being press-fitted to the head main body 41 until impinging on a stepped portion 33*a* (refer to FIG. 6) in a ring-like shape produced by the rotational force transmitting portion 44 and the ring mounting face 45. Therefore, by the mounting, the screw ring 34 is arranged contiguous to a side of the one end 41*b* relative to the rotational force transmitting portion 44.

The coil spring 35 is contained in the spring containing hole 38 of the crown shaft 32 and is squeezed between a center portion of the closed portion 42 opposed to the containing hole 38 of the crown shaft 32 and the crown shaft 32. The coil spring 35 always urges the crown head 33 in a direction of separating from the outer side face 14*b* of the case band 14.

In the wrist watch 10 having the above-described constitution, FIG. 2 shows a state in which the crown 31 is arranged at a position of not being pulled out (generally referred to as 'zero stage'). At the 'zero stage', the female screw portion 43 of the crown 31 is brought in mesh with the male screw portion 24 of the pipe 21, the one end 41*b* of the head main body 41 and the screw ring 34 are brought into contact with the outer side face 14*b* of the case band 14, thereby, the crown 31 is positioned to the case band 14.

Along therewith, the inserting portion 25 of the pipe 21 is inserted through the screw ring 34 and the rotational force transmitting portion 44 of the crown head 33 is opposed to the outer periphery of the inserting portion 25. Further, the rotational force transmitting portion 44 is separated in a direction of the outer side face 14*b* of the case band 14 relative to the rotational force receiving portion 32*b* of the crown shaft 32, and the rotational force receiving portion 32*b* of the crown head 33 and the rotational force transmitting portion 44 of the crown shaft 32 are maintained in a state of not having a coupling relationship. Under the state, the rotational force receiving portion 32*b* is arranged to be proximate to the inner face of the closed portion 42 of the crown head 33 and front ends of the respective teeth 36 are disposed to be brought into inner contact with the inner peripheral face 46 of the crown head 33. Therefore, the rotational force receiving portion 32*b* supports the crown head 33 from an inner side.

As described above, at the 'zero stage', the crown 31 is brought into a state of being locked by the screw. Under the state, the male screw portion 24 and the female screw portion 43 are brought in mesh with each other. Therefore, the crown head 33 is not moved in the axial direction although the coil spring 35 is brought into a state of being strongly compressed between the closed portion 42 of the crown head 33 and the crown shaft 32 and the crown head 33 is urged in the direction of being separated from the case band 14.

When time of the timepiece movement 13 is set, the crown head 33 brought into the screw lock state is pulled out to a position referred to as '1 stage' to be operated to rotate. That is, first, the crown head 33 is rotated in a loosening direction, and the female screw portion 43 is brought into a state of being detached from the male screw portion 24. In this case, the crown head 33 and the crown shaft 32 are not provided with the coupling relationship, and therefore, the crown shaft 32 is not rotated cooperatively with the crown head 33 in accordance with an operation of rotating the crown head 33 releasing from mesh.

Simultaneous with releasing the mesh of the screw portion, by a spring force (urge force) of the coil spring 35, the crown head 33 is moved to separate from the outer side face 14*b* of the case band 14 along an axial direction of the crown shaft 32.

The crown shaft 32 and the crown head 33 are connected in accordance with a movement in the axial direction of the crown head 33. That is, the rotational force transmitting portion 44 constituting the shape of the inner teeth gear is fitted to the rotational force receiving portion 32*b* constituting the shape of the outer teeth gear, and the crown shaft 32 and the crown head 33 are coupled to be held to be cooperatively rotated along an axis.

Simultaneous therewith, the screw ring 34 having the female screw portion 43 impinges on a side face on a side of the case band 14 of the rotational force receiving portion 32*b*, and therefore, the movement of the crown head 33 in the axial direction is restricted by constituting a stopper by the rotational force receiving portion 32*b* and the crown head 33 is stopped from being detached. By the restriction, the coupling, in other words, the engagement of the first engaging portion and the second engaging portion is maintained, and the crown 31 released from the screw lock state is maintained at the pull out position referred to as '1 stage' as shown by FIG. 3. Along therewith, the screw ring 34 is arranged to be fitted to be brought into outer contact with the inserting portion 35 of the crown shaft 32.

In connecting the crown shaft 32 and the crown head 33, there is a case in which time and labor of more or less rotating the crown head 33 is needed. The teeth 44*a* of the rotational force transmitting portion 44 and teeth 36 of the rotational force receiving portion 32*b* are formed by the serrations. Therefore, when the time and labor is needed for bringing the teeth 36 and the teeth 44*a* in mesh with each other as described above, an amount of rotation thereof is constituted by at least an amount of 1 pitch of the teeth. In a state of releasing the screw lock in this way, an operability of the crown head 33 for bringing the rotational force transmitting portion 44 in mesh with the outer peripheral portion of the rotational force receiving portion 32*b* is excellent.

By manually rotating the crown head 33 of the crown 31 at the pull out position of the crown head 33 explained above (refer to FIG. 3), rotation of the crown head 33 is transmitted to the crown shaft 32 by way of the rotational force transmitting portion 44 and the rotational force receiving portion 32*b*. In accordance therewith, the rotational force is exerted to the timepiece movement 13 by way of the hand setting stem 39, and therefore, adjustment of the timepiece movement 13 of setting time or the like can be carried out.

After the adjustment, the crown 31 is brought into the lock state (refer to FIG. 2) again. The operation of achieving the screw lock state is carried out first, by pushing back the crown head 33 in the direction of the case band 14 against the coil spring 35, thereafter, the female screw portion 43 of the screw ring 34 provided to the crown 31 is rotated in a fastening direction to be screwed to the male screw portion 24 of the pipe 21. Thereby, the one end 41*b* of the crown head 33 and the screw ring 34 are brought into contact with the outer side face 14*b* of the case band 14, and therefore, the crown 31 can be brought into the screw lock state such that the crown 31 is not carelessly rotated in carrying the wrist watch 10 or the like.

In the operation of providing the screw lock state, first, in accordance with pushing back the crown head 33 in the direction of the case band 14, the rotational force transmitting portion 44 is detached from the rotational force receiving portion 32*b*, and therefore, connection of the crown head 33 and the crown shaft 32 is released. Further, thereafter, by operating to rotate the crown head 33, the female screw portion 43 is brought in mesh with the male screw portion 24.

The screw lock operation which is carried out by rotating the crown head 33 in the fastening direction in this way is carried out in a state in which the crown head 33 and the crown shaft 32 are not connected, and therefore, rotation of the crown head 33 in the fastening direction is not transmitted to the crown shaft 32.

In accordance with the screw lock operation to provide the screw lock state as described above, the crown shaft 32 is rotated, rotation is not transmitted to the mechanical type timepiece movement 13, and therefore, in the screw lock operation, the main spring provided to the timepiece movement 13 is prevented from constituting a load. Therefore, even in a state of, for example, winding up the mainspring considerably, the screw lock operation of the crown 31 can lightly be carried out and the operability is excellent.

Further, when the timepiece movement 13 is not of a mechanical type but is provided with a function of changing an operation mode by the crown 31 arranged at the position of 'zero stage', as described above, the rotational force is prevented from being propagated to the timepiece movement in accordance with the screw lock operation of the crown 31, and therefore, the operation mode is not carelessly changed.

Further, as described above, in accordance with being able to lightly carry out the screw lock operation of the mechanical type timepiece movement 13 having the mainspring, an excessive rotation operating force is not applied to the male screw portion 24 and the female screw portion 43, and therefore, durability of the screw portions 23 and 43 can be promoted.

Further, as described above, regardless of movement in the axial direction of the crown head 33 in the screw lock operation and in releasing the screw lock state, the crown shaft 32 is not moved in the axial direction. Therefore, connection of the hand setting stem 39 and the crown shaft 32 can be carried out by a simple screwing structure without needing a device for preventing the movement in the axial direction of the crown shaft 32 from being propagated to the hand setting stem 39 at the hand setting stem 39 and the crown shaft 32. Therefore, cost of working the hand setting stem 39 can be reduced, and therefore, the constitution can contribute to a reduction in cost of a total of the wrist watch.

Furthermore, the screw shaft can be adopted for the hand setting stem 39, and therefore, in assembling the wrist watch 10, the hand setting stem 39 can be attached to the crown shaft 32 at a later stage without being restricted by preparing a crown attached with a hand setting stem in which the hand setting stem 39 is previously fixed to the crown 31. Thereby, the hand setting stem 39 previously worked with a screw portion to be maximally long can be cut by a necessary length to be screwed to be connected to the crown shaft 32 by being adapted to a size of the timepiece exterior assembly 11 which differs by a type of the wrist watch 10, a dimension necessary for achieving the screw lock state and the like. Therefore, in fabrication, general purpose performance of the hand setting stem 39 is increased, the hand setting stem 39 can commonly be used by a number of kinds of the wristwatches 10 and can contribute to a reduction in a cost of the total of the wrist watch 10 in accordance therewith.

As described above, in the state of releasing the screw lock, the respective teeth 36 of the rotational force receiving portion 32*b* of the crown shaft 32 are brought into inner contact with the inner peripheral face 46 of the crown head 33. That is, the respective teeth 36 are slightly brought into contact with or extremely proximate to the inner peripheral face 46. Thereby, the crown head 33 can be supported by the rotational force receiving portion 32*b* from the inner side.

Therefore, when the crown head 33 is moved in the direction of being separated from the case band 14 by the urge force of the coil spring 35 in accordance with releasing the screw lock for the crown 31, and when the crown head 33 is moved in the direction of the case band 14 against the urge force of the coil spring 35 in bringing about the screw lock state from the state of releasing the screw lock for the crown 31, the axial movement of the crown head 33 can be guided by the rotational force receiving portion 32*b* throughout a major part of the range of axial movement of the crown 31. Therefore, the crown head 33 can be moved in the axial direction stably without shaking the crown head 33.

Further, the screw ring 34 is arranged to be brought into outer contact with the inserting portion 25 of the pipe 21 as described above until the female screw portion 43 is started to be brought in mesh with the male screw portion 24 from the state of releasing the screw lock for the crown 31. In other words, the inserting portion 25 of the pipe 21 is inserted to the screw ring 34 and the screw ring 34 is guided by the inserting portion 25 from the inner side. Also in this respect, the crown head 33 can be moved in the axial direction stably without shaking the crown head 33.

As described above, the crown head 33 can be moved in the axial direction by making the crown head 33 stable so as not to be shaken by the rotational force receiving portion 32*b* of the crown shaft 32 and the inserting portion 25 of the pipe 21. Thereby, when the crown 31 is brought into the screw lock state, the female screw portion 43 of the screw ring 34 is restrained from being forcibly brought in mesh with the male screw portion 24 of the pipe 21, and the female screw portion 43 of the screw ring 34 can be started to be properly brought in mesh with the male screw portion 24 of the pipe 21.

Next, a procedure of fabricating the crown 31 will be explained.

First, the crown shaft 32, the crown head 33, the screw ring 34, and the coil spring 35 which is not needed to work are prepared.

The screw ring 34 is provided by screwing an inner periphery of a material of a ring type, not illustrated. The female screw portion 43 can be formed by the working. In this case, the ring type material which is a part separate from the crown head 33 is used, and therefore, an effective length of the female screw portion 43 in accordance with a width of the material can maximally be ensured.

The crown shaft 32 is provided by carrying out necessary working of providing the plurality of teeth 36 or the like for a material of the crown shaft, not illustrated. The material of the crown shaft includes a shaft main portion and a shaft end portion in a circular shape expanded integrally from an outer periphery of one end portion of the shaft main portion to an outer side. The ring-like recessed portion for attaching the waterproof packing 40, the screw hole 37 and the spring containing hole 38 are machined for the shaft main portion. The plurality of teeth 36 are worked by machining using a shaper or punching using a press by a work member, not illustrated, moved in an axial direction of the material of the crown shaft for the outer peripheral portion of the shaft end portion.

The crown head 33 is provided by carrying out necessary working for a head material. As shown by FIG. 6, according to the head material 51, other end of the head main body 41 one end of which is opened is closed by the closed portion 42, a worked projected portion 52 is provided at an inner periphery of the head main body 41, and the head material 51 includes a first space 53 and a second space 54 at inside of the head main body 41 by constituting a boundary by the worked projected portion 52. The worked projected portion 52 constitutes a circular ring shape continuous in a peripheral direction at an inner periphery of the head main body 41. The first space 53 is partitioned by a maximum diameter of the worked projected portion 52, that is, the inner peripheral face 46 in a circular shape having a diameter equal to or larger than a diameter of a circle drawn by passing a projected base portion, and is formed between the worked projected portion 52 and the closed portion 42. The second space 54 is partitioned by the ring mounting face 45 of the circular shape having a diameter equal to or larger than the maximum diameter of the worked projected portion 52 and is formed between the worked projected portion 52 and the opened one end 41*b* of the head main body 41.

The head material 51 is worked for the worked projected portion 52. In working the worked projected portion 52, the plurality of teeth 44*a* are worked at the worked projected portion 52 by a work member, not illustrated, reaching the first space 53 from the second space 54 by passing the worked projected portion 52 and the rotational force transmitting portion 44 of a shape attachably and detachably fitted to the rotational force receiving portion 32*b* is formed. In this case, the teeth 44*a* are worked by machining by using a shaper or punching by using a press. Further, a two-dotted chain line in FIG. 6 indicates a depth of working the worked projected portion 52.

According to the working, by the constitution of the head material 51 for constituting the crown head 33, the work member working the plurality of teeth 44*a* at the worked projected portion 52 is not hindered from passing through the worked projected portion 52 by the ring mounting face 45 and the inner peripheral face 46, and therefore, a workability of the rotational force transmitting portion 44 provided to the crown head 33 can be promoted. In addition thereto, the screw ring 34 is not integral with the crown head 33 but is attached to the crown head 33, and therefore, the screw ring 34 does not constitute a hindrance in working the rotational force transmitting portion 44 for the head material 51.

Therefore, despite that other end of the head material 51 is closed by the closed portion 42, the rotational force transmitting portion 44 can easily be worked at the worked projected portion 52 by working by using a shaper or punching by using a press suitable for mass production performance and the teeth 44*a* of the rotational force transmitting portion 44 can accurately be worked.

Next, the crown shaft 32, the crown head 33, the screw ring 34 and the coil spring 35 which are prepared are assembled.

First, the crown head 33 is made to cover the crown shaft 32 while squeezing the coil spring 35 in a compressed state between the closed portion 42 of the crown head 33 and the crown shaft 32. Thereby, the rotational force receiving portion 32*b* is contained in the first space 53. Thereafter, the screw ring 34 is mounted to the ring mounting face 45 by press-fitting the screw ring 34 into the second space 54 of the crown head 33.

Second Embodiment

Figure 8:
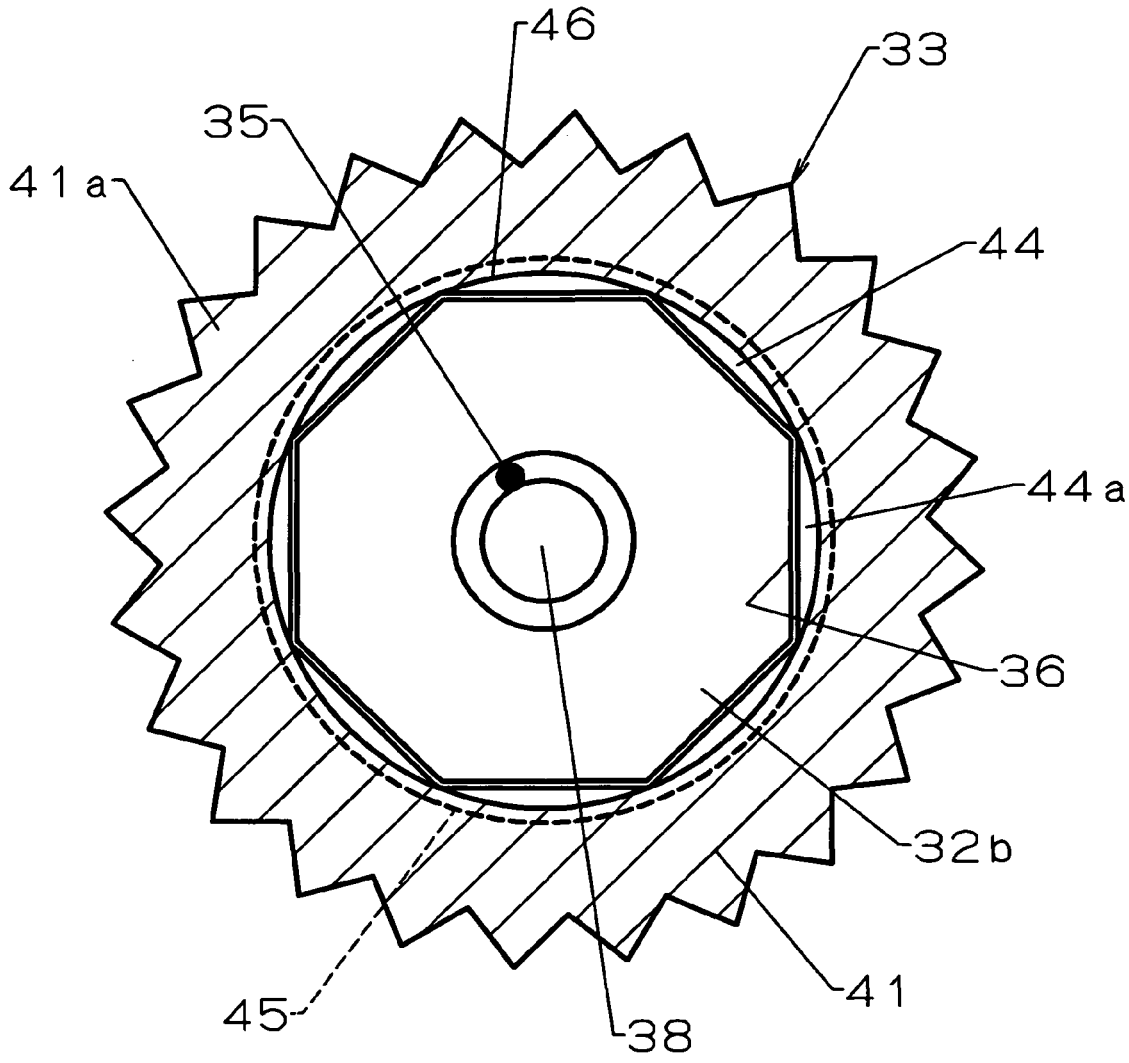
FIG. 8 is a sectional view in correspondence with FIG. 4 showing a crown provided to a wrist watch according to a second embodiment of the invention.

A second embodiment of the invention will be explained in reference to FIG. 8. The second embodiment is basically the same as the first embodiment. Therefore, portions the same as those of the first embodiment are attached with notations the same as those of the first embodiment and an explanation thereof will be omitted, and an explanation will be given of portions different from those of the first embodiment as follows.

According to the second embodiment, the first engaging portion 36 provided at an outer peripheral portion of the rotational force receiving portion 32*b* is formed by a regular polygonal shape, specifically, a regular octagonal shape, in accordance therewith, also the second engaging portion 44*a* provided at the rotational force transmitting portion 44 fitted attachably and detachably to the rotational force receiving portion 32*b* is formed by a regular polygonal shape, specifically, a regular octagonal shape. Other than the point, the constitution is the same as that of the first embodiment including a constitution not shown in FIG. 8.

Therefore, also in the wrist watch 10 of the second embodiment, the problem which the invention is to solve can be solved by achieving an operation the same as that of the first embodiment.

What is claimed is:

1. A portable timepiece, comprising: a case band including a timepiece movement; a pipe attached to the case band and having a male screw portion disposed on an outer side of the case band; and a crown connected to a hand setting stem for transmitting a rotational force to the timepiece movement, the crown being movable into and out of mesh with the male screw portion and being held so as not to be rotated by bringing the crown into mesh with the male screw portion, the crown having a head main body constituting a cylindrical shape of a crown head, and a crown guide that makes sliding contact with an inner peripheral face of the head main body throughout a major part of the range of movement of the crown in an axial direction to guide movement of the crown head in the axial direction, the crown head being arranged outside of the pipe for cooperatively moving the hand setting stem in a state in which the crown and the male screw portion are not in mesh with each other.

2. A portable timepiece according to claim 1; wherein a rotational force transmitting portion including a first engaging portion is provided at an inner face of the head main body in the cylindrically-shaped crown head, and a rotational force receiving portion including a second engaging portion having a shape in correspondence with the first engaging portion and engaged and detached with and from the first engaging portion by the movement in the axial direction of the crown head serves also as the crown guide.

3. A portable timepiece, comprising: a case band including a timepiece movement; a pipe attached to the case band and having a male screw portion disposed on an outer side of the case band; and a crown connected to a hand setting stem for transmitting a rotational force to the timepiece movement, the crown being movable into and out of mesh with the male screw portion, and the crown being held so as not to be rotated by bringing the crown in mesh with the male screw portion, the crown comprising:

a crown shaft including a rotational force receiving portion that has a first engaging portion at an outer periphery thereof, a diameter larger than a diameter of the male screw portion, and is arranged outside of the pipe and cooperatively moving the hand setting stem in a state in which the crown and the male screw portion are not in mesh with each other;

a crown head having a head main body that has an open end and a closed end, an inner periphery of the head main body including a rotational force transmitting portion, a ring mounting face in a circular shape, and an inner peripheral face in a circular shape, the rotational force transmitting portion having a second engaging portion engageable with and disengageable from the first engaging portion of the rotational force receiving portion, the ring mounting face being formed on one end side from the rotational force transmitting portion and having a diameter equal to or larger than a maximum diameter of the rotational force transmitting portion, and the inner peripheral face being formed on the other end side from the rotational force transmitting portion and having a diameter equal to or larger than the maximum diameter of the rotational force transmitting portion and making sliding contact with the first engaging portion;

a screw ring including a female screw portion movable into and out of mesh with the male screw portion and having a diameter smaller than a diameter of the rotational force receiving portion and being mounted to the ring mounting face; and an elastic member compressed between the crown head and the crown shaft for urging the crown head in a direction of being separated from the case band.

4. A portable timepiece according to claim 3; wherein the pipe has an inserting portion formed to be brought into inner contact with the female screw portion and made to be continuous to the male screw portion of the pipe, and a length of the inserting portion is constituted by a length inserted into the screw ring in a state in which the screw ring is not in mesh with the male screw portion.

5. A portable timepiece according to claim 3; wherein the first and the second engaging portions comprise serrations.

6. A portable timepiece according to claim 4; wherein the first and the second engaging portions comprise serrations.

7. A portable timepiece according to claim 3; wherein the head main body and the closed end are integrally formed.

8. A portable timepiece according to claim 4; wherein the head main body and the closed end are integrally formed.

9. A portable timepiece according to claim 5; wherein the head main body and the closed end are integrally formed.

10. A portable timepiece according to claim 6; wherein the head main body and the closed end are integrally formed.

11. A portable timepiece comprising: a case band; a timepiece movement disposed in the case band and having a hand setting stem; a pipe extending through and attached to the case band, the pipe having a male screw portion on a part of the pipe that extends outside the case band; and a crown having a crown head and a crown shaft, the crown head having a female screw portion threadedly engaged with the male screw portion and being disengageable therefrom in response to rotation of the crown head in a loosening direction accompanied by axial movement of the crown head in a direction away from the case band, and the crown shaft having one end portion extending into the pipe and connected to the hand setting stem and another end portion extending outside the case band beyond the pipe and slidably contacting an inner peripheral surface of the crown head to support the crown head and guide the axial movement thereof.

12. A portable timepiece according to claim 11; wherein the crown shaft has a force receiving portion for receiving a rotational force to rotate the hand setting stem, and the crown head has a force transmitting portion releasably engageable with the force receiving portion during axial movement of the crown head away from the case band to enable a rotational force to be transmitted to the force receiving portion by rotating the crown head.

13. A portable timepiece according to claim 12; wherein the force receiving portion and the force transmitting portion are configured and arranged to releasably engage one another following axial movement of the crown head to a position in which the male and female screw portions are disengaged from one another.

14. A portable timepiece according to claim 13; wherein the other end portion of the crown shaft that slidably contacts the inner peripheral surface of the crown head constitutes the force receiving portion of the crown shaft.

15. A portable timepiece according to claim 13; wherein the force receiving portion and the force transmitting portion both comprise serrations.

16. A portable timepiece according to claim 13; wherein the force receiving portion and the force transmitting portion both have a regular polygon shape.

17. A portable timepiece according to claim 12; wherein the other end portion of the crown shaft that slidably contacts the inner peripheral surface of the crown head constitutes the force receiving portion of the crown shaft.

18. A portable timepiece according to claim 12; wherein the force receiving portion and the force transmitting portion both comprise serrations.

19. A portable timepiece according to claim 12; wherein the force receiving portion and the force transmitting portion both have a regular polygon shape.

20. A portable timepiece according to claim 11; wherein the crown head has a cylindrical side wall having an open end through which the pipe and crown shaft extend and a closed end which is integral with the side wall.

* * * * *